US009546637B2

(12) United States Patent
Tanaya et al.

(10) Patent No.: US 9,546,637 B2
(45) Date of Patent: Jan. 17, 2017

(54) IGNITION APPARATUS

(75) Inventors: Kimihiko Tanaya, Tokyo (JP); Futoshi Aida, Tokyo (JP); Hiroshi Okuda, Tokyo (JP); Takayoshi Nagai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 752 days.

(21) Appl. No.: 13/267,562

(22) Filed: Oct. 6, 2011

(65) Prior Publication Data

US 2012/0293088 A1 Nov. 22, 2012

(30) Foreign Application Priority Data

May 16, 2011 (JP) ..... 2011-109337

(51) Int. Cl.
*H05B 37/02* (2006.01)
*F02P 3/09* (2006.01)
(Continued)

(52) U.S. Cl.
CPC ..... *F02P 3/0892* (2013.01); *F02P 15/10* (2013.01); *H01T 13/50* (2013.01); *H01T 15/00* (2013.01)

(58) Field of Classification Search
CPC ..... H05B 2214/03; H05B 3/48; H05B 41/24; H05B 41/382; H02J 17/00; H02J 3/18; H02J 7/0054; H02J 7/025; H02J 7/1407
(Continued)

(56) References Cited

U.S. PATENT DOCUMENTS 3,331,986 A * 7/1967 Hardin et al. ..... 315/200 R
4,733,646 A * 3/1988 Iwasaki ..... 123/597
(Continued)

FOREIGN PATENT DOCUMENTS

JP 49-28720 A 3/1974
JP 63036062 A 2/1988
(Continued)

OTHER PUBLICATIONS

Japanese Office Action issued Apr. 24, 2012 in corresponding Japanese Patent Application No. 2011-109337.
(Continued)

*Primary Examiner* — Tuyet Vo
*Assistant Examiner* — Amy Yang
(74) *Attorney, Agent, or Firm* — Sughrue Mion, PLLC; Richard C. Turner

(57) ABSTRACT

An ignition apparatus includes: sparking coil supplying a sparking plug with a high voltage; an energy supply device supplying the sparking coil with energy; a first switch disposed therebetween; and a control device controlling the first switch's conduction. The energy supply device has a DC power supply, a resonance coil connected to the DC power supply, a sparking capacitor connected to the resonance coil, and a second switch disposed between the sparking capacitor and an earth, and charges the sparking capacitor to have a voltage value larger than that of the DC power supply in absolute value by making the resonance coil and the sparking capacitor generate an LC resonance when the second and first switches are turned ON and OFF, respectively, according to an instruction from the control device whereas supplying the sparking coil with energy when the second and first switches are operated inversely according to another instruction.

11 Claims, 2 Drawing Sheets

(51) Int. Cl.

| | |
|---|---|
| ***H01T 15/00*** | (2006.01) |
| ***F02P 3/08*** | (2006.01) |
| ***F02P 15/10*** | (2006.01) |
| ***H01T 13/50*** | (2006.01) |

(58) Field of Classification Search
USPC ..... 315/308, 224, 225, 291, 209, 307
See application file for complete search history.

(56) References Cited

U.S. PATENT DOCUMENTS

| | | | | |
|---|---|---|---|---|
| 6,662,792 | B2 * | 12/2003 | Dutt et al. | 123/598 |
| 8,807,124 | B2 * | 8/2014 | Tanaya | F02P 3/0807 123/605 |
| 2006/0021607 | A1 * | 2/2006 | Toriyama | F02P 3/096 123/598 |
| 2009/0126710 | A1 * | 5/2009 | Alger et al. | 123/636 |

FOREIGN PATENT DOCUMENTS

| | | | |
|---|---|---|---|
| JP | 2002-523674 | A | 7/2002 |
| JP | 4497027 | B2 | 7/2010 |

OTHER PUBLICATIONS

Japanese Office Action, Patent Appln No. 2011-109337, Nov. 13, 2012.

* cited by examiner

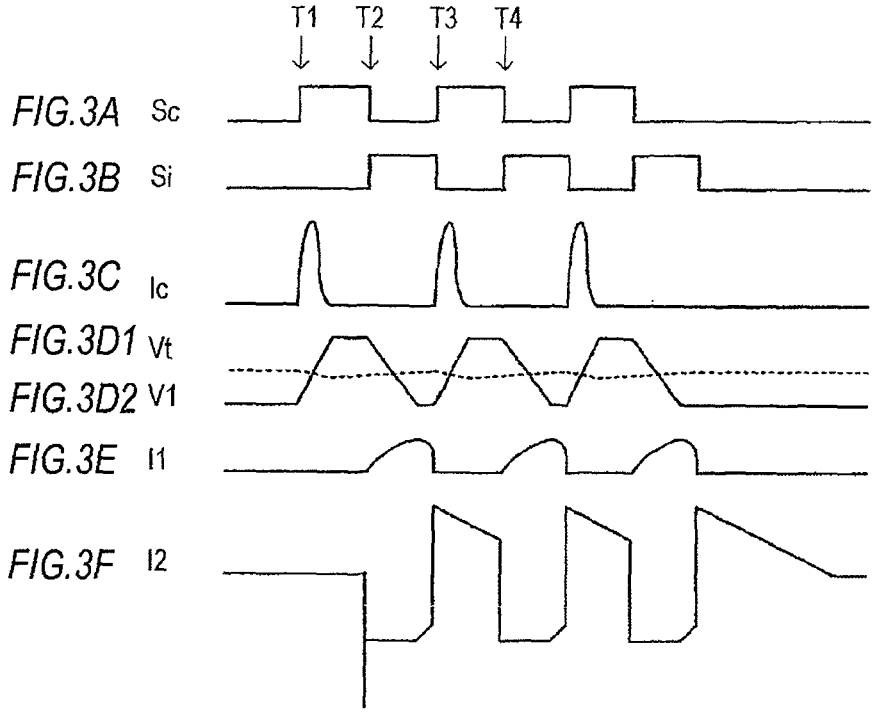
T1
T2
T3
T4
FIG.3A Sc
FIG.3B Si
FIG.3C Ic
FIG.3D1 Vt
FIG.3D2 V1
FIG.3E I1
FIG.3F I2
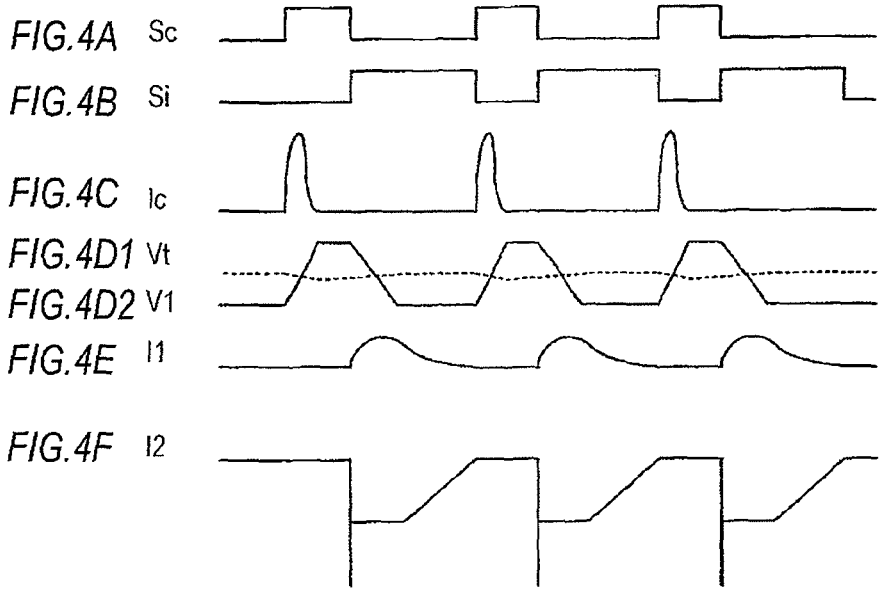
FIG.4A Sc
FIG.4B Si
FIG.4C Ic
FIG.4D1 Vt
FIG.4D2 V1
FIG.4E I1
FIG.4F I2

IGNITION APPARATUS

BACKGROUND OF THE INVENTION

Field of the Invention

The present invention relates to a capacitive discharge ignition apparatus chiefly employed in an internal combustion engine.

Background Art

Issues on environmental preservation and fuel depletion are being raised recently and actions toward these issues are urgently necessary in the auto industry. One example of such actions is ultra-lean combustion of an engine using a stratified mixture, so-called stratified lean combustion. Stratified lean combustion is a technique to burn a combustible air-fuel mixture generated only in a partial region within a combustion chamber, that is, a region in the vicinity of a sparking plug. With this technique, an intake loss can be reduced and a coefficient of thermal expansion can be enhanced.

Because fuel is collected only in the vicinity of the sparking plug by the stratified lean combustion, a method using a flow of air called a swirl flow is used extensively. This method takes an advantage of the nature of air that flows toward the center of a swirl. By disposing a sparking plug at the center of a swirl and allowing fuel to flow on the swirl, it becomes possible to collect the fuel in the vicinity of the sparking plug, thereby enabling the stratified lean combustion.

Accordingly, there is a possibility with the stratified lean combustion that the combustible mixture is not distributed homogeneously, and a spark discharge over a long period is required from the viewpoint of firing opportunity. A concentration of the mixture is not homogeneous, either, and in these circumstances, a fume leakage caused by carbon deposits on the sparking plug readily occurs. In view of the foregoing, a high secondary current is necessary for the stratified lean combustion to generate a spark discharge in a reliable manner even in circumstances where an energy leakage pathway has been formed.

In response to this necessity, an ignition apparatus described in Patent Document 1 has been proposed. The ignition apparatus described in Patent Document 1 uses a capacitive discharge ignition method to give rise to a breakdown between electrodes of an ignition plug. By supplying energy intermittently to a primary end of the sparking coil from a coil having pre-stored the energy to maintain a following inductive discharge, an AC spark discharge is generated continuously between the electrodes of the sparking plug. Both a high initial secondary current and a spark discharge over a long period can be thus achieved.

Patent Document 1: Japanese Patent No. 4497027

Meanwhile, strong eddying flow and current of the combustible mixture develop in the vicinity of the sparking plug and these eddying flow and current make it difficult to start and continue a spark discharge for fuel ignition. The spark discharge is a phenomenon that molecules between the electrodes are turned into plasma by a action or the like with a high voltage applied between the electrodes and a current is flowed through the plasma. There is, however, a phenomenon (blow-off phenomenon) that molecules turned into plasma per se are flowed by the strong current described above or the plasma disappears with cooling. It therefore becomes difficult to start a spark discharge and should a discharge be started, the spark discharge is interrupted when a path (plasma) through which to flow the current disappears.

The ignition apparatus described in Patent Document 1 has a problem that the blow-off phenomenon readily occurs during an operation on a low discharge current. In other words, because a discharge current per se of the spark discharge contributes to generation of plasma, which serves as a path, when the discharge current is large, the current itself is able to repair the path even when the path is blown off. The path is therefore seldom interrupted and the blow-off phenomenon hardly occurs. In contrast, when the discharge current is small, plasma generated by the current itself is too small to repair the path quickly enough. The path is therefore interrupted easily and the blow-off phenomenon readily occurs.

Hence, once the discharge is interrupted, it becomes impossible to give rise to a breakdown again between the electrodes of the sparking plug. The spark discharge is therefore interrupted and ends at this point.

In circumstances where there is a fume leakage pathway between the electrodes of the sparking plug, an initial breakdown is possible due to the capacitive discharge method. However, when a spark discharge current thereafter is small, a large proportion of energy leaks through the leakage pathway. Hence, as with the description above, there is a case where the spark discharge cannot be maintained, causing a firing opportunity to be missed.

In addition, the ignition apparatus of Patent Document 1 proposes a scheme equipped with DC-to-DC converters separately used for a normal operation and stratified lean combustion and generating a further larger discharge current. To achieve this scheme, however, a further larger DC-to-DC converter and a further larger energy storing coil are necessary. This proposed scheme therefore has problems of heat generation and a large size of the product.

SUMMARY OF THE INVENTION

The invention has an object to solve the problems discussed above by providing a compact capacitive discharge ignition apparatus achieving a high secondary current and a spark discharge over a long period and capable of resuming a spark discharge by giving rise to a breakdown again even when the spark discharge is interrupted.

An ignition apparatus according to an aspect of the invention includes: a sparking coil that supplies a sparking plug with a high voltage; an energy supply device that supplies the sparking coil with energy; a first switch that is disposed between the sparking coil and the energy supply device; and a control device that controls conduction of the first switch. The energy supply device has a DC power supply, a resonance coil connected to the DC power supply, a sparking capacitor connected to the resonance coil, and a second switch disposed between the sparking capacitor and an earth. The energy supply device charges the sparking capacitor to have a voltage value larger than an output voltage value of the DC power supply in absolute value by making the resonance coil and the sparking capacitor generate an LC resonance when the second switch is turned ON and the first switch is turned OFF according to a first instruction from the control device, and supplies the sparking coil with the energy supplied to the sparking capacitor when the second switch is turned OFF and the first switch is turned ON according to a second instruction from the control device.

The ignition apparatus of the invention can be compact, achieve a high secondary current and a spark discharge over a long period, and resume a spark discharge by giving rise to a breakdown again even when the spark discharge is interrupted.

The foregoing and other object, features, aspects, and advantages of the present invention will become more apparent from the following detailed description of the present invention when taken conjunction with the accompanying drawings.

BRIEF DESCRIPTION OF THE DRAWINGS

FIGS. 3A to 3F represent a timing chart showing waveforms at respective portions in the ignition apparatus of FIG. 2; and FIGS. 4A to 4F represent another timing chart showing waveforms at respective portions in the ignition apparatus of FIG. 2.

DESCRIPTION OF THE PREFERRED EMBODIMENTS

First Embodiment

Figure 1:
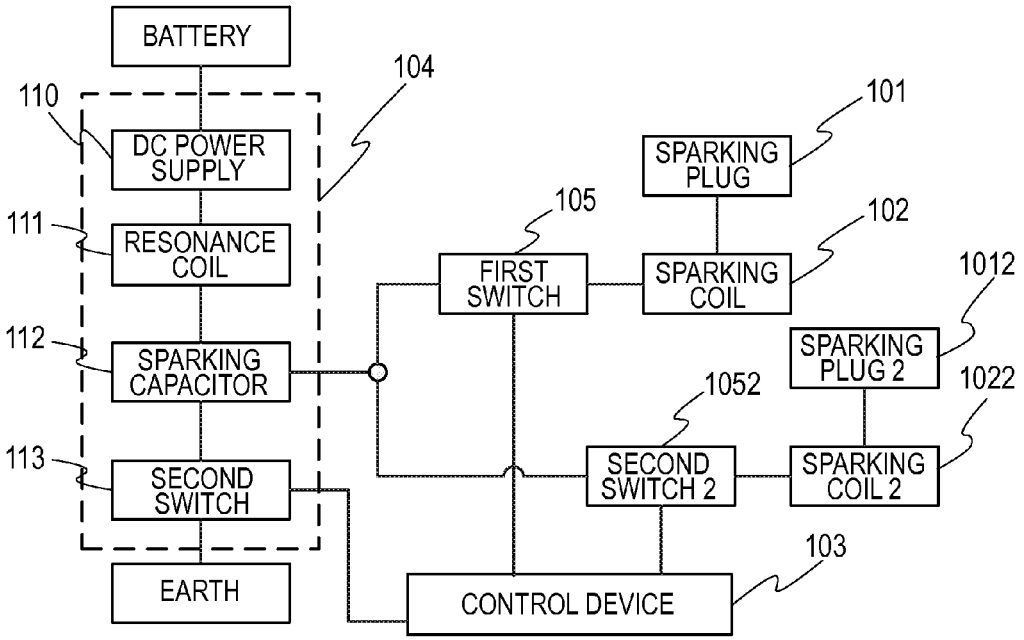
FIG. 1 is a view schematically showing a configuration of an ignition apparatus according to a first embodiment of the invention.

FIG. 1 schematically shows a configuration of an ignition apparatus of the invention. Referring to FIG. 1, energy is supplied from an energy supply device 104 to a sparking coil 102 that supplies a sparking plug 101 with a high voltage with which to generate a spark discharge. A first switch 105 is disposed between the sparking coil 102 and the energy supply device 104 and it operates under predetermined control by a control device 103. The energy supply device 104 includes a DC power supply 110 formed of a battery or the like, a resonance coil 111 connected to the DC power supply 110, a sparking capacitor 112 connected to the resonance coil 111, and a second switch 113 disposed between the sparking capacitor 112 and an earth 109.

The energy supply device 104 stores energy according to a control signal from the control device 103. The stored energy is supplied to the sparking coil 102 via the first switch 105 according to an instruction from the control device 103. The sparking coil 102 generates a high voltage upon a supply of the energy and applies the high voltage between the electrodes of the sparking plug 101, which gives rise to a breakdown and a spark discharge between the electrodes of the sparking plug 101.

Figure 2:
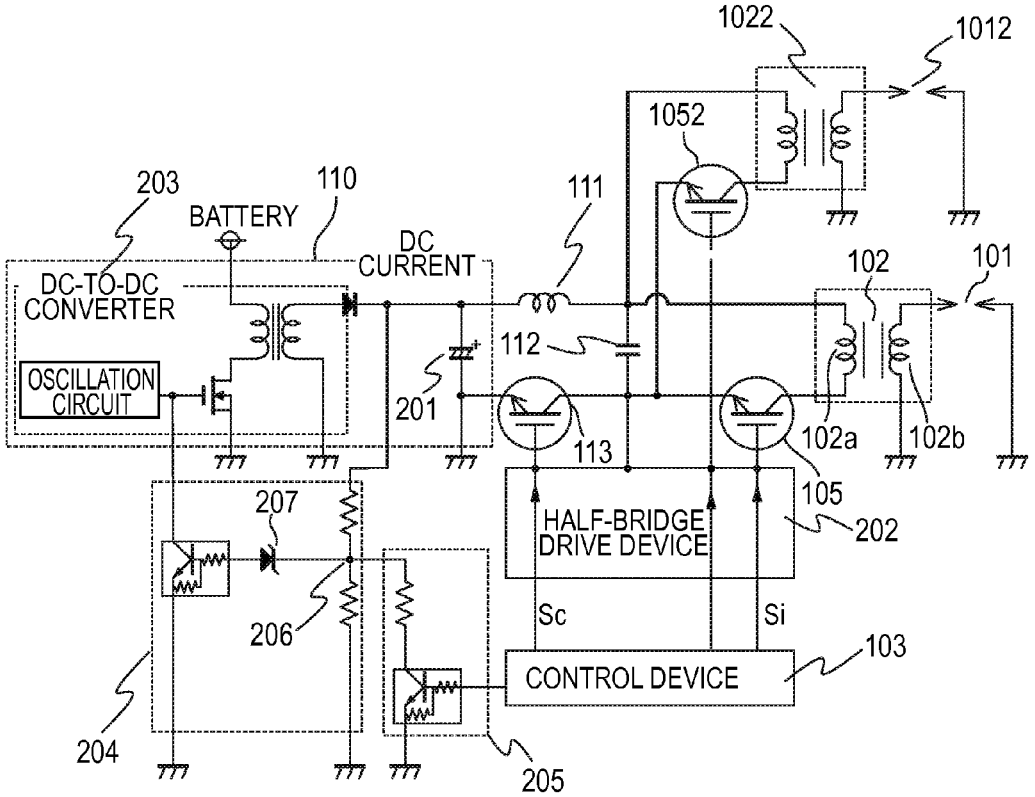
FIG. 2 is a view showing a circuit configuration of the ignition apparatus according to the first embodiment of the invention.

FIG. 2 is a view showing a concrete circuit configuration of the ignition apparatus according to the first embodiment of the invention. In the drawing, like components are labeled with like reference numerals with respect to FIG. 1. Referring to FIG. 2, the DC power supply 110 is formed of a known DC-to-DC converter 203 and attached thereto are a monitor circuit 204 and a voltage regulator circuit 205 both described below. In an example shown herein, the first switch 105 and the second switch 113 each are formed of an IGBT. It should be appreciated, however, that the invention is not limited to this example and an IGBT can be replaced with a power transistor or a MOSFET. A half-bridge drive circuit 202 is used to drive the first switch 105 and the second switch 113, in particular, to stabilize potential at an emitter (source) of the first switch 105 in a floating state and a commercially available half-bride drive circuit can be used.

The DC-to-DC converter 203 in the DC power supply 110 boosts the battery 100 and is able to supply a sufficient DC current for a short time. The resonance coil 111, the sparking capacitor 112, and the second switch 113 are disposed in series between the DC power supply 110 and the earth 109. In addition, the first switch 105 is disposed between the sparking capacitor 112 and the sparking coil 102 and ON and OFF operations of the first switch 105 and the second switch 113 are controlled by the control device 103.

A circuit operation of FIG. 2 including an internal operation of the energy supply device 104 will now be described. As the second switch 113 is turned ON, that is, as the sparking capacitor 112 and the earth 109 are brought into conduction while the first switch 105 stays OFF, that is, while the sparking capacitor 112 and the sparking coil 102 are not conducting, a current starts to flow from the DC power supply 110 to the earth 109. In this instance, an LC resonance is generated between the resonance coil 111 and the sparking capacitor 112 and a voltage is raised higher than a voltage of DC power supply 110. With this raised voltage, the sparking capacitor 112 is charged quite fast to have a voltage higher than the voltage of the DC power supply 110.

After the charging of the sparking capacitor 112 is completed, the second switch 113 is turned OFF and the first switch 105 is turned ON. Then, charges stored in the sparking capacitor 112 flow into the sparking coil 102, upon which the sparking coil 102 generates a high voltage. This high voltage gives rise to a spark discharge between the electrodes of the sparking plug 101. An ignition operation of an internal combustion engine is thus carried out.

As has been described, according to the ignition apparatus of the first embodiment, the sparking capacitor 112 can be charged quite fast. Hence, even when the energy supply device 104 is formed of one circuit, for example, when the sparking capacitor 112 has only one circuit, it becomes possible to supply energy to more than one cylinder by providing a plurality of secondary coils 102*b* to the sparking coil 102.

In short, because the energy supply source can be shared, the apparatus can be reduced in size and cost.

It is preferable to dispose the energy supply device 104 in the same package as a product. Alternatively, the energy supply device 104 together with the half-bridge drive device 202 used to drive the first switch 105 and the second switch 113 described below may be disposed in the same package. Further, the control device 103 may also be disposed in the same package.

An operation of multi-sparking using the ignition apparatus of the invention will now be described.

Initially, the DC power supply 110 is boosted by the DC-to-DC converter 203 to have a battery voltage at or exceeding 100 V and charges a capacitor 201 to be capable of supplying a sufficient current to the following stage. Hereinafter, the capacitor 201 is referred to as the tank capacitor.

A capacity of the tank capacitor 201 has to be sufficiently large for a capacity of the sparking capacitor 112. The tank capacitor 201 is responsible for most of a supply of energy to the sparking capacitor 112. Given a case where a supply of energy is necessary a plurality of times in a short time like in multi-sparking, then it is necessary for the tank capacitor 201 to secure a sufficient capacity difference. Herein, a selection is made so that a capacity of the tank capacitor 201 is about 10μ to 100 μF and a capacity of the sparking capacitor 112 is about 0.5μ to 5 μF, thereby ensuring a capacity difference of about 10 to 20 times.

A potential difference across the tank capacitor 201 is constantly monitored by the monitor circuit 204, so that, for example, when potential at a resistance voltage dividing point 206 reaches a breakdown voltage of a zener diode (or avalanche diode) 207, a transistor 208 is turned ON to stop a boosting operation by the DC-to-DC converter 203. When configured in this manner, wasteful power consumption and hence unnecessary heat generation can be suppressed. A contribution can therefore be made to a further reduction of the device in size and cost.

By adding the voltage regulator circuit 205 to the monitor circuit 204 of FIG. 2, energy to be supplied to the sparking coil 102 can be varied with an operation condition. Further, the apparatus consumes less power and the life of the sparking plug 101 is prolonged. For example, when an internal transistor 209 is turned ON by sending a control signal from the control device 103 to the voltage regulator circuit 205, divided potential at the resistance voltage dividing point 206 drops. Because the breakdown voltage of the zener diode 207 does not vary, it becomes necessary to further raise a charging voltage of the tank capacitor 201 to achieve the breakdown voltage. It thus becomes possible to adjust a potential difference across the tank capacitor 201. Accordingly, because a charging amount of the sparking capacitor 112 is adjustable, it becomes possible to adjust magnitude of a secondary voltage V2 and a secondary current I2 generated in the secondary winding wire 102*b* of the sparking coil 102.

A charging target of the tank capacitor 201 is set, for example, to 100 V mainly and 160 V after the switching. Both are extremely low as a voltage to be supplied to a primary end of a capacitive discharge sparking coil. However, because a voltage can be raised by about two times using an LC resonance in the circuit in the latter stage, about 200 to 320 V is given as a potential difference across the sparking capacitor that directly supplies energy to the primary end of the sparking coil. Hence, an output voltage at a level as high as or higher than that of a typical capacitive discharge ignition apparatus can be obtained. Also, when a charging target of the tank capacitor 201 is a voltage about 100 to 160 V, a general-purpose electronic part can be used. The range of choice for parts is therefore broadened extensively and a compact and inexpensive part can be chosen. Also, because a DC-to-DC converter having a small output with good efficiency can be chosen, heat generation can be suppressed.

A charging operation of the sparking capacitor 112 will now be described with reference to a timing chart of FIGS. 3A to 3F. In the drawing, FIG. 3A represents a control signal waveform Sc applied to the second switch 113 from the control device 103 via the half-bridge drive circuit 202, FIG. 3B represents a control signal waveform Si applied to the first switch 105 also from the control device 103 via the half-bridge drive circuit 202, FIG. 3C represents a current waveform Ic flowed into the sparking capacitor 112 when the second switch 113 is turned ON, FIG. 3D1 represents a potential difference Vt (broken line) across the tank capacitor 201, FIG. 3D2 represents a potential difference V1 (solid line) across the sparking capacitor 112, FIG. 3E represents a primary current I1 flowed into a primary winding wire 102*a* of the sparking coil 102 from the sparking capacitor 112, and FIG. 3F represents a secondary current I2 flowed into the secondary winding wire 102*b*.

As is represented by FIG. 3A, when the signal Sc shifts to a high level (timing T1 of FIGS. 3A to 3F), the second switch 113 is turned ON, that is, switched to a conducting state. Then, a current represented by FIG. 3C flows into the sparking capacitor 112 from the tank capacitor 201 via the resonance coil 111. In this instance, because of an LC resonance occurring between the resonance coil 111 and the sparking capacitor 112, the sparking capacitor 112 is charged with potential at least two times higher than the potential difference Vt (broken line) across the tank capacitor 201 represented by FIG. 3D1. The potential difference V1 (solid line) across the fully charged sparking capacitor 112 is therefore about 200 V as is represented by FIG. 3D2. The charging time is as short as 10μ to 20 μsec and such a short charging time enables capacitive discharge multi-sparking described below.

A sparking operation thereafter will now be described. The control device 103 shifts the control signal Sc (represented by FIG. 3A) to a low level (timing T2 of FIGS. 3A to 3F to switch the second switch 113 to a non-conducting state. Thereafter, the control device 103 shifts the control signal Si to a high level and switches the first switch 105 to a conducting state. In this instance, attention should be paid to prevent the first switch 105 and the second switch 113 from being switched to a conducting state at the same time. Accordingly, the circuit configuration in the control device 103 is limited so that the control signal Sc does not logically shift to a high level at the same time. When the both switches are switched to a conducting state at the same time, all the energy stored in the tank capacitor 201 flows directly into the primary winding wire 102*a* of the sparking coil 102. Hence, in order to resume the sparking, the tank capacitor 201 has to be charged all over again. This charging, however, takes a time and it becomes impossible to carry out an operation within a short time, such as multi-sparking.

Also, because the emitter of the first switch 105 is not grounded and in a floating state, it is necessary to drive the first switch 105 using the half-bridge drive device 202. To this end, the half-bridge drive device 202 includes a capacitor (not shown) capable of generating a potential difference large enough to drive the gate of the IGBT. The half-bridge drive device 202 drives the first switch 105 in a stable manner by generating a potential different using the capacitor when the control signal Sc is at a high level and giving the potential difference to the gate of the first switch 105 in reference to the emitter of the first switch 105 when the control signal Si shifts to a high level.

When the first switch 105 is turned ON, that is, switched to a conducting state, the primary current I1 represented by FIG. 3E flows through the primary winding wire 102*a* of the sparking coil 102 from the sparking capacitor 112. When a current starts to flow through the primary winding wire 102*a*, a high voltage V2 by an induced electromotive force is generated in the secondary winding wire 102*b*, which is magnetically coupled to the primary winding wire 102*a* and has more turns than the primary winding wire 102*a*, in a forward direction (herein, a direction in which a center electrode (secondary wiring wire side) of the sparking plug 101 becomes negative is defined as the forward direction). This gives rise to a breakdown between the electrodes of the sparking plug 101. Accordingly, the secondary current I2 represented by FIG. 3F flows between the electrodes of the sparking plug 101 in a forward direction (in the case of FIG. 3F, a direction in which the current (denoted as I2 in the drawing) flows toward the center electrode from the negative side, that is, a side electrode (GND side) of the sparking plug 101, is defined as the forward direction).

An operation of multi-sparking will now be described. As is represented by FIG. 3E, when the control signal Si is shifted to a low level (timing T3 of FIGS. 3A to 3F), that is, when the first switch 105 is switched to a non-conducting state while the primary current I1 is flowing, the high voltage V2 in a direction opposite to the direction specified above is generated in the secondary winding wire 102*b* by an induced electromotive force. Accordingly, the secondary current I2 in the opposite direction (that is, toward the positive side) as is represented by FIG. 3F flows continuously.

Immediately after the control signal Si is shifted to a low level (slightly after the timing T3 of FIGS. 3A to 3F, the sparking capacitor 112 is re-charged by shifting the control signal Sc to a high level as is represented by FIG. 3A and thereby switching the second switch 113 to a conducting state. The re-charging of the sparking capacitor 112 is completed while a spark discharge in the opposite direction is continuing and the control signal Si (represented by FIG. 3B) is shifted to a high level (timing T4 of FIGS. 3A to 3F). Then, an induced electromotive force in the forward direction is generated again and a discharge current starts to flow continuously in the forward direction this time.

In this manner, by repeating the switching operations successively while the spark discharge is continuing, it becomes possible to flow a spark discharge current continuously in the forward direction and the opposite direction, that is, to give rise to an AC continuous spark discharge. In order to generate such an AC continuous spark discharge, it is preferable to set the number of turns of the primary wiring wire 102*a* and that of the secondary winding wire 102*b* of the sparking coil 102 at a high ratio, for example, it is preferable to set a ratio of about 100 times to 200 times. Also, it is preferable to provide a large number of turns, for example, 5000 to 10000 turns, to the secondary wiring wire 102*b* so that a discharging time characteristic of the sparking coil 102 becomes slightly longer. It is preferable to set intervals of the switching operations to 50μ to 500 μsec.

Second Embodiment

Another charging operation of the sparking coil 112 will now be described with reference to a timing chart of FIGS. 4A to 4F. In the drawing, descriptions of FIGS. 4A to 4F are the same as those of the respective waveforms of FIGS. 3A to 3F. That is, FIG. 4A represents the control signal waveform Sc, FIG. 4B represents the control signal waveform Si, FIG. 4C represents the current waveform Ic flowed into the sparking capacitor 112 when the second switch 113 is turned ON, FIG. 4D1 represents the potential difference Vt (broken line) across the tank capacitor 201, FIG. 4D2 represents the potential difference V1 (solid line) across the sparking capacitor 112, FIG. 4E represents the primary current I1 flowed into the primary winding wire 102*a* of the sparking coil 102 from the sparking capacitor 112, and FIG. 4F represents the secondary current I2 flowed into the secondary winding wire 102*b*.

A difference from FIGS. 3A to 3F is that, in FIGS. 3A to 3F, the control signal Si is shifted to a low level (timing T3 of FIGS. 3A to 3F) while the primary current I1 is flowing whereas in FIGS. 4A to 4F, a sparking operation as follows is carried out repetitively. That is, the control signal Si (represented by FIG. 4B) is shifted to a low level when the primary current I1 (represented by FIG. 4E) flowing through the primary winding wire 102*a* of the sparking coil 102 has stopped flowing. Subsequently, the control signal Sc (represented by FIG. 4A) is shifted to a high level to re-charge the sparking capacitor 112. Then, after the control signal Sc (represented by FIG. 4A) is shifted to a low level, the control signal Si (represented by FIG. 4B) is shifted again to a high level.

When configured in this manner, a spark ignition discharge becomes intermittent. However, as in the first embodiment above, it becomes possible to obtain a firing opportunity over a long period. According to the second embodiment, because continuity of discharge is not required for the ignition apparatus, in a case where there is a considerable gap between the charging voltage monitor value of the tank capacitor 201 monitored by the monitor circuit 204 and a target value, for example, in a case where the monitor value drops below 50 V when the charging target is 100 V, the transistor 208 is brought into conduction to inhibit multi-sparking or an amount of consumed charges is reduced by decreasing the number of times of multi-sparking or a charging period is extended by setting intervals of multi-sparking longer, for example, by carrying out multi-sparking ten times at intervals of 100 μsec or five times at intervals of 200 μsec when multi-sparking is normally carried out 20 times at intervals of 50 μsec. Consequently, high priority is given to charging to carry out a following sparking in a reliable manner while maintaining the same firing period.

As has been described, according to the invention, because a boosting voltage of the DC-to-DC converter can be suppressed to a low voltage by using an LC resonance, it becomes possible to allow the DC-to-DC converter to operate efficiently, which can in turn suppress power consumption of the circuit to a low level.

In addition, because a boosting voltage of the DC-to-DC converter can be suppressed to a low voltage by using an LC resonance, parts having low voltage resistance can be chosen. The apparatus can be therefore reduced in size and cost. Further, because the sparking capacitor can be charged in a quite short time, an AC continuous spark discharge and capacitive discharge multi-sparking are enabled.

The ignition apparatus of the invention can be incorporated into a broad range of vehicles or the like using an internal combustion engine, such as automobiles, two-wheeled vehicles, outboard engines, and other special machines, to ignite fuel in a reliable manner. Hence, not only can the ignition apparatus make the internal combustion engine operate efficiently, but also the ignition apparatus can be of help to issues on fuel depletion and environment preservation.

Various modifications and alterations of this invention will be apparent to those skilled in the art without departing from the scope and spirit of this invention, and it should be understood that this is not limited to the illustrative embodiments set forth herein.

What is claimed is:

1. An ignition apparatus comprising:

a sparking coil for supplying a sparking plug with a high voltage;

an energy supply device for supplying the sparking coil with energy;

a first switch connected between the sparking coil and the sparking capacitor; and a control device for controlling conduction of the first switch, wherein:

the energy supply device comprises a DC power supply, a resonance coil connected to the DC power supply, a sparking capacitor connected to the resonance coil, and a second switch connected between the sparking capacitor and an earth;

the energy supply device charges the sparking capacitor to have a voltage value larger than an output voltage value of the DC power supply in absolute value by making the resonance coil and the sparking capacitor generate an LC resonance when the second switch is turned ON and the first switch is turned OFF according to a first instruction from the control device, and supplies the sparking coil with the energy supplied to the sparking capacitor when the second switch is turned OFF and the first switch is turned ON according to a second instruction from the control device, the first and second instructions control respective switching operations of the corresponding switches in such a way that when the first switch is turned ON, the second switch becomes turned OFF, and when the first switch is turned OFF, the second switch becomes turned ON; and an emitter of the first switch is directly connected to a collector of the second switch.

2. The ignition apparatus according to claim 1, wherein:

the energy supply device has a half-bridge drive circuit that enables switching of the first switch after a switching operation of the second switch; and the emitter of the first switch is connected to the half-bridge drive circuit.

3. The ignition apparatus according to claim 1, wherein:

the sparking coil includes a plurality of sparking coils and the energy supply device supplies the plurality of sparking coils with the energy.

4. The ignition apparatus according to claim 1, wherein:

the DC power supply, resonance coil, sparking capacitor, and second switch of the energy supply device are disposed in single package.

5. The ignition apparatus according to claim 1, wherein:

the second instruction is set to switch to a low level while a primary current of the sparking coil is flowing and subsequently the first instruction is set to switch to a high level.

6. The ignition apparatus according to claim 1, wherein:

the second instruction is set to switch a low level when a primary current of the sparking coil stops flowing and subsequently the first instruction is set to switch to a high level.

7. The ignition apparatus according to claim 1, wherein:

the DC power supply comprises a voltage regulator circuit configured to change the output voltage of the DC power supply according to an instruction from the control device.

8. The ignition apparatus according to claim 1, wherein the first and the second switches are turned ON and OFF with an approximately 50% duty cycle, and an input signal to a gate of the first switch is controlled based on an output signal from the emitter of the first switch.

9. An ignition apparatus, comprising:

a sparking coil for supplying a sparking plug with a high voltage;

an energy supply device for supplying the sparking coil with energy;

a first switch connected between the sparking coil and the energy supply device; and a control device for controlling conduction of the first switch, wherein:

the energy supply device comprises a DC power supply, a resonance coil connected to the DC power supply, a sparking capacitor connected to the resonance coil, and a second switch connected between the sparking capacitor and an earth;

the energy supply device charges the sparking capacitor to have a voltage value larger than an output voltage value of the DC power supply in absolute value by making the resonance coil and the sparking capacitor generate an LC resonance when the second switch is turned ON and the first switch is turned OFF according to a first instruction from the control device, and supplies the sparking coil with the energy supplied to the sparking capacitor when the second switch is turned OFF and the first switch is turned ON according to a second instruction from the control device;

the first and second instructions control respective switching operations of the corresponding switches in such a way that when the first switch is turned ON, the second switch becomes turned OFF, and when the first switch is turned OFF, the second switch becomes turned ON;

the DC power supply comprises a DC-to-DC converter, a tank capacitor charged with an output voltage from the converter, and a monitor circuit monitoring a charging voltage of the tank capacitor; and the monitor circuit controls an operation of the DC-to-DC converter when there is a considerable gap between the output voltage and a charging target voltage of the tank capacitor to carry out one of actions to inhibit multi-sparking, reduce the number of times of multi-sparking, and extend intervals of multi-sparking.

10. The ignition apparatus of claim 9, wherein the DC power supply has a voltage regulator circuit that changes the output voltage according to an instruction from the control device.

11. An ignition apparatus comprising:

a plurality of sparking coils configured to supply a sparking plug with a high voltage;

an energy supply device configured to supply the plurality of sparking coils with energy, the energy supply device comprising a DC power supply, a resonance coil, a sparking capacitor, and a second switch;

a first switch disposed between the plurality of sparking coils and the sparking capacitor; and a controller configured to control conduction of the first switch, wherein the energy supply device charges the sparking capacitor to have a voltage value larger than an output voltage value of the DC power supply in absolute value by making the resonance coil and the sparking capacitor generate an LC resonance according to a first instruction from the controller, and supplies the plurality of sparking coils with the energy supplied to the sparking capacitor according to a second instruction from the controller, wherein the first and second instructions control respective switching operations of the corresponding switches in such a way that when the first switch is turned ON, the second switch becomes turned OFF, and when the first switch is turned OFF, the second switch becomes turned ON, and wherein an emitter of the first switch is directly connected to a collector of the second switch.

* * * * *